United States Patent [19]

Rudolph

[11] 4,163,272

[45] Jul. 31, 1979

[54] ARRANGEMENT FOR ARC-QUENCHING IN ARRESTERS

[75] Inventor: René Rudolph, Zurich, Switzerland

[73] Assignee: BBC Brown, Boveri & Company Limited, Baden, Switzerland

[21] Appl. No.: 850,374

[22] Filed: Nov. 10, 1977

[30] Foreign Application Priority Data

Jan. 20, 1977 [CH] Switzerland ..... 67077/77

[51] Int. Cl.[2] ..... H01T 1/04

[52] U.S. Cl. ..... 361/127; 361/134

[58] Field of Search ..... 361/133, 134, 136, 127, 361/128

[56] References Cited

U.S. PATENT DOCUMENTS

| | | | |
|---|---|---|---|
| 3,159,765 | 12/1964 | Schultz et al. | 361/134 X |
| 3,531,690 | 9/1970 | Sakshaug et al. | 361/134 X |
| 3,543,097 | 11/1970 | Smith | 361/134 |

*Primary Examiner*—Harry E. Moose, Jr.

*Attorney, Agent, or Firm*—Burns, Doane, Swecker & Mathis

[57] ABSTRACT

An electrical arrester structure includes an arc quenching chamber in which are located a pair of spaced principal electrodes between which a quenched arc gap is formed, an associated blow-out coil for magnetically influencing and expanding the arc formed between these electrodes and an auxiliary electrode which together with the principal electrode adjacent thereto forms an auxiliary arc gap. The auxiliary electrode is connected directly to one end of a leakage resistor and the other end of this leakage resistor is electrically connected either through the blow-out coil or directly to the principal electrode which is adjacent the auxiliary electrode with the result that the auxiliary arc gap will fire before the voltage protective level of the arrester is reached and cause the leakage resistor which is series connected with the quenched arc gap to be bridged.

9 Claims, 3 Drawing Figures

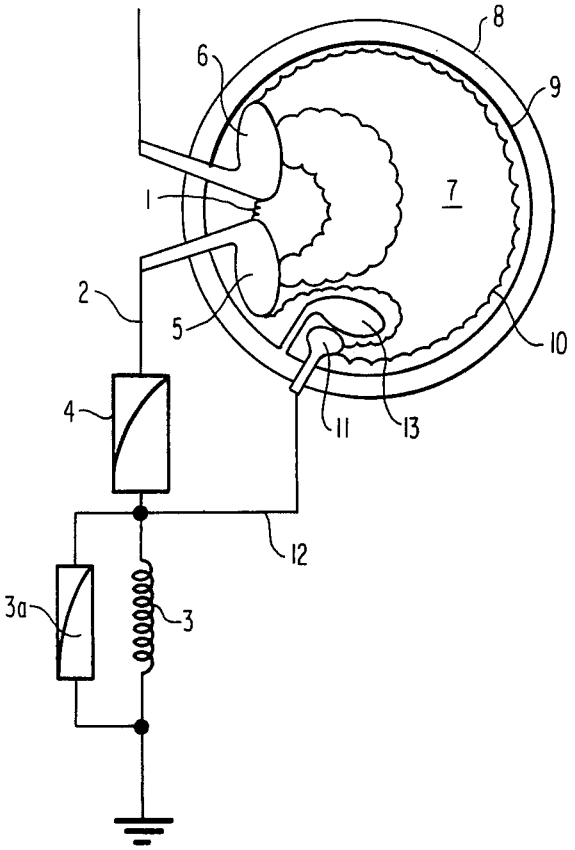
FIG 2
FIG 3
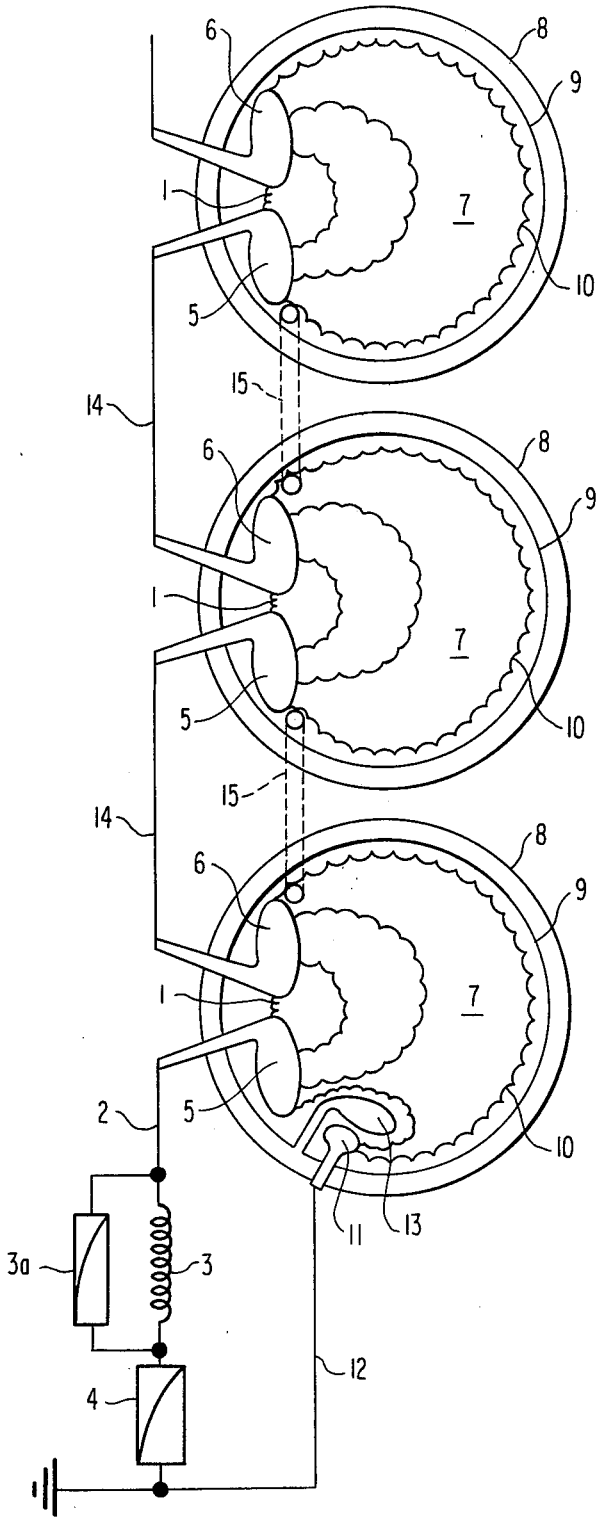

ARRANGEMENT FOR ARC-QUENCHING IN ARRESTERS

BACKGROUND OF THE INVENTION

The present invention relates to an improved arrangement for quenching the arcs formed in arresters and wherein for the purpose of current-limiting there are provided at least one device equipped with a discharge path and at least one resistor, and wherein means are included for bridging-over the resistor with a time delay after ignition of the discharge path has taken place.

An arrangement of this general type is already known from Swiss Pat. No. 512,845 and which has, for the purpose of avoiding any impairment of the protective characteristic of an arrester after the build-up of a discharge voltage, an arrangement comprising a discharge path followed by a resistor. This arrangement, however, comprises two separate structural components, namely, a discharge device for effecting current limitation, and a separate device including a firing chamber for effecting a bridging-over of the resistor. This is not an optimal solution, neither in an electrical nor in a mechanical respect because the use of two separate devices will obviously result in a substantial increase in cost of an arrangement for arc quenching and will furthermore require a corresponding large amount of space.

In my co-pending United States patent application Ser. No. 696,228 filed June 15, 1976 now U.S. Pat. No. 4,072,996 an arrangement for arc quenching in arresters is disclosed which comprises a discharge path in the form of a quenched arc gap located in a quenching chamber and a blow-out coil associated with the chamber for effecting a magnetic blow-out, i.e., lengthening of the arc, and wherein the quenching chamber is equipped, in addition to a pair of electrodes which establish the quenched arc gap, with an auxiliary electrode which together with the adjacent electrode of the quenched arc gap forms an auxiliary arc gap, and wherein the auxiliary electrode is also connected to that adjacent electrode by way of a blow-out coil. An arrangement of this type produces, by the use of relatively simple means, a high quenching capacity of the arrester due to the current which flows through the short-circuited blow-out coil at the instant of the follow-up current peak value independent of the follow-up current. The leakage current of such arresters protecting low-impedance current sources such as cable sections or batteries of condensers will rise very rapidly and can reach very high values. If this value exceeds a critical magnitude, it will effect the travel path of the arc and thus reduce the quenching capability of the arrester. For this reason, it will become necessary to connect a leakage resistance in series with the arc for the purpose of current limitation. The voltage drop across such resistance will be additive with the arc voltage. When the arc voltage has been built up after a certain period of time its magnitude will come close to the protection level of the arrester. Therefore, the sum of the arc and resistance voltages can easily exceed the protective level and result in destruction of the component which is desired to be protected by the arrester.

Published German patent application DT-OS No. 2,040,053 discloses an arc path arrangement for an arrester with magnetic blow-out and where, for the purpose of lengthening the arc and reducing the possibility of back-arcing, a plurality of quenching chambers are assembled in superposed relation and provided with openings for establishing the necessary electrical connections between adjacent chambers. Arrangements of this type will result in a lengthening of the arc by giving it a spiral-like configuration but not in limitation of the leakage current without a transgression of the protective level with a leakage resistance placed in succession.

SUMMARY OF THE INVENTION

It is therefore the principal object of the present invention to provide an improved arrangement for quenching the arc occurring in arresters wherein the current-limiting discharge gap and the means, bridging over with time delay the resistance which limits the current at the beginning of the discharge, are accommodated within one single discharge region, and with the further objective of attaining the highest possible arc voltage in the discharge gap while, at the same time avoiding any transgression of the protective level of the arrester at the moment of its response.

In accordance with the invention, these objectives are attained by an arrangement wherein the discharge path in the arrester structure contains at least one quenched arc gap with an associated blow-out coil for magnetically influencing the arc in the quenching chamber, wherein the quenching chamber contains, in addition to the two principal electrodes which form the quenched arc gap, an auxiliary electrode which forms, together with the principal electrode adjacent to it, an auxiliary arc gap, and wherein the auxiliary electrode is connected by an electrical conductor directly to one end of a leakage resistor, the other end of this leakage resistor being electrically connected to the principal electrode which is adjacent the auxiliary electrode.

It will be expedient to connect the leakage resistor at its voltage side with the auxiliary electrode of the auxiliary arc gap or with the adjacent principal electrode of the quenched arc gap respectively either by way of the series-connected blow-out coil, or directly by means of an electrical conductor, and it will be advantageous to place the blow-out coil between ground and the grounded-side of the leakage resistor.

In a preferred embodiment of the invention, a screen is provided between the auxiliary electrode of the auxiliary arc gap and the adjacent principal electrode of the quenched arc gap which serves to partially cut off the auxiliary electrode from the arc generated across the principal electrodes of the quenched arc gap, thus making it possible to set the firing instant of the auxiliary electrode by the specific shape in which the screen is made.

If it becomes necessary in connection with the invention to employ arresters for an extremely high arc voltage, it will be particularly advantageous to arrange, in a manner knwon per se, a plurality of quenching chambers arranged in superposed relation, and by providing electrical connections between adjacent chambers thus establishing the formation of a spiral-shaped arc.

The improved arrangement proposed by the invention offers significant advantages in the case of arresters and leakage resistors connected in series for the purpose of current limitation because it provides a particularly simple, reliable and economic manner for increasing the protective level of the arrester structure, and further allows the presence of a high arc voltage if such high voltage is required.

BRIEF DESCRIPTION OF DRAWINGS

The foregoing objects and other advantages inherent in the invention will become more apparent from the following detailed description of a preferred embodiment thereof and which is illustrated in the accompanying drawings, in which

FIG. 2 illustrates a second embodiment of the present invention; and

FIG. 3 illustrates an embodiment of the invention which includes a plurality of superposed quenching chambers.

DETAILED DESCRIPTION OF THE PREFERRED EMBODIMENT

Figure 1:
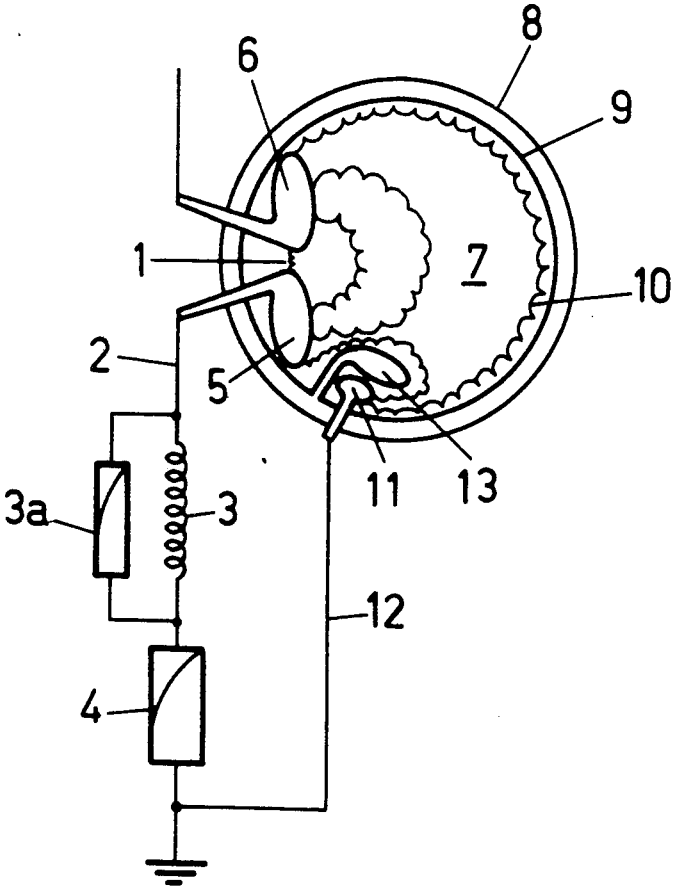
FIG. 1 shows the improved arrester structure and related circuit arrangement in a simplified manner.

With reference now to FIG. 1, the improved arrester in accordance with the invention shown generally as a top plan comprises a quenching chamber 7 within which are located a pair of spaced principal electrodes 5 and 6 adjacent the internal surface 9 of the chamber and between which a quenched arc gap 1 can be formed. The essentially cylindrical outer side wall of the chamber is indicated by numeral 8. An auxiliary electrode 11 is also positioned adjacent the internal surface 9 of the quenching chamber 7 in the vicinity of principal electrode 5, this auxiliary electrode being protected by a screen 13 from an arc formation over a small portion of the overall path of the arc 10 which burns between the electrodes 5, 6 around the internal surface 9 of the quenching chamber as a result of the magnetic blow-out. As illustrated in FIG. 1, the screen 13 includes a first portion which projects radially inward from the wall 8 between the principal electrode 5 and the auxiliary electrode 11, and a second portion disposed at an angle with respect to the first portion and overlying the auxiliary electrode 11. An electrical conductor 2 serves to connect electrode 5 to one end of a blow-out coil 3 which latter has a by-pass resistor 3*a* connected in parallel therewith. The other end of blow-out coil 3 is connected to one end of a non-linear leakage resistor 4, and the other end of the latter is connected to ground. Another electrical conductor 12 serves to connect auxiliary electrode 11 to the grounded side of leakage resistor 4.

If now an over-voltage appears across the arrester, a resulting follow-up current flows through a path consisting of electrode 6, arc 10, electrode 5, blow-out coil 3 and leakage resistor 4 to ground. When the arc is driven by the magnetic field produced by coil 3 to the internal surface 9 of the quenching chamber 7, the arc voltage is fully built up. Since the voltage drop across leakage resistor 4 and the full arc voltage which comes close to the protective level of the arrester are additive, this total voltage, which also appears across the electrical device desired to be protected, may exceed the protective level of the arrester, and thus the permissible voltage, and could possibly lead to a destruction of the electrical device. It is for this reason that the leakage resistor 4 is bridged over before the combined voltage exceeds the protective level of the arrester. This is accomplished by shaping and placing the screen 13 in such manner that the auxiliary arc gap, as shown in the drawing, will fire before the total voltage reaches the protective level of the arrester, i.e., at a time when the full arc voltage has not as yet been fully built up in the quenching chamber. The resulting follow-up current will now flow to ground by way of electrode 11 and conductor 12.

The objective of the invention can also be attained by a somewhat different arrangement than that illustrated in the drawing. For example, the illustrated arrangement could be modified by connecting the voltage side, i.e., the "live" side of leakage resister 4 directly with principal electrode 5 of the auxiliary, or the quenched arc gap 1 by way of conductor 2. The blow-out coil 3 is then most expediently placed between ground and the ground-side end of the leakage resistor 4, as shown in FIG. 2. An additional increase in the back-fire resistance and in the protective level of the arrester as proposed by the invention is attainable by a superposed arrangement of quenching chambers each as illustrated in FIG. 3, with each such chamber 7 provided with an electrically conductive connection to the chambers adjacent thereto. The electrically conductive connection can be an electrical conductor 14 which connects adjacent quenching chambers in series, or a conduit 15 which connects adjacent quenching chambers in series. If such an arrangement is used, the arc will form in the shape of a spiral.

I claim:

1. In an arrangement for quenching the arc formed in an arrester for the purpose of current limiting and which includes at least one device equipped with a discharge path and at least one leakage resistor, and wherein means are included for bridging the resistor with a time delay following firing of the discharge path the improvement wherein said discharge path contains at least one quenched arc gap established by a pair of spaced principal electrodes located within a quenching chamber and an associated blow-out coil for magnetically influencing the arc formed in said chamber, said quenching chamber also including an auxiliary electrode which together with the principal electrode adjacent thereto forms an auxiliary arc gap, said auxiliary electrode being connected by a conductor directly to one end of said leakage resistor, the other end of said leakage resistor being electrically connected to the said principal electrode which is adjacent said auxiliary electrode.

2. An arrangement for arc quenching in an arrester as defined in claim 1 wherein said other end of said leakage resistor is electrically connected to the principal electrode which is adjacent said auxiliary electrode by way of said blow-out coil which is connected in series therewith.

3. An arrangement for arc quenching in an arrester as defined in claim 1 wherein the other end of said leakage resistor is connected directly to the principal electrode which is adjacent said auxiliary electrode by means of an electrical conductor.

4. An arrangement for arc quenching in an arrester as defined in claim 1 wherein the other end of said leakage resistor is connected directly to the principal electrode which is adjacent said auxiliary electrode by means of an electrical conductor and wherein said blow-out coil is connected between the end of said leakage resistor which is connected to said auxiliary electrode and ground.

5. An arrangement for arch quenching in an arrester as defined in claim 1 and which further includes a screen interposed between said auxiliary electrode and the principal electrode adjacent thereto which serves to partially cut off said auxiliary electrode from the arc generated between said principal electrodes.

6. An arrangement for arc quenching in an arrester as defined in claim 5 wherein said screen has a first portion interposed between said auxiliary electrode and said principal electrode adjacent thereto, and a second portion disposed at an angle with respect to said first portion and overlying said auxiliary electrode so as to cause said auxiliary arc gap to fire upon a response of said arrester before the total voltage arising across said arrester and the leakage resistor exceeds the protective level of said arrester.

7. An arrangement for arc quenching in an arrester as defined in claim 1 and wherein for the purpose of increasing the arc voltage a plurality of said quenching chambers are superposed and electrically connected in series.

8. An arrangement for arc quenching in an arrester as defined in claim 7 and wherein an electrical conductor serves as means for connecting adjacent quenching chambers in series.

9. An arrangement for arc quenching in an arrester as defined in claim 7 and wherein an arc burning within a conduit serves as means for connecting adjacent quenching chambers in series.

* * * * *